United States Patent [19]
Sayles
[11] 4,167,428
[45] Sep. 11, 1979

[54] CONDUCTANCE METHOD FOR DETERMINING THE MECHANICAL PROPERTIES OF PROPELLANTS

[75] Inventor: David C. Sayles, Huntsville, Ala.

[73] Assignee: The United States of America as represented by the Secretary of the Army, Washington, D.C.

[21] Appl. No.: 471,251

[22] Filed: May 17, 1974

[51] Int. Cl.[2] ..... C06B 23/00

[52] U.S. Cl. ..... 149/109.6; 149/19.9; 149/20; 324/71 R

[58] Field of Search ..... 149/109.6, 19.9, 20; 324/30 R, 30 A, 71 R

[56] References Cited

U.S. PATENT DOCUMENTS

| | | | |
|---|---|---|---|
| 1,889,462 | 11/1932 | Bazylewicz-Kniazykowski et al. | 149/109.6 X |
| 3,207,584 | 9/1965 | Alley et al. | 149/109.6 X |
| 3,682,727 | 8/1972 | Heinzelmann et al. | 149/19.9 X |
| 3,698,967 | 10/1972 | Thompson et al. | 149/19.9 |
| 3,762,969 | 10/1973 | Sayles | 149/20 X |
| 3,864,178 | 2/1975 | Rudy et al. | 149/109.4 |

*Primary Examiner*—Richard D. Lovering
*Attorney, Agent, or Firm*—Nathan Edelberg; Robert P. Gibson; Jack W. Voigt

[57] ABSTRACT

A solid propellant grain is converted from a non-conductive filled elastomer into a highly-conductive filled elastomer by introducing an effective amount of an alkali metal tungstate or the analogous ammonium salt which, in addition to imparting electrical conductance characteristics, also functions as an oxidizer in the propellant composition. When sodium tungstates, known as tungsten bronzes, or the analogous ammonium salt, are used to replace from 1 to 3 parts of the ammonium perchlorate oxidizer in the propellant formulation, it changes the grain to a highly-conductive grain, and, thereby, permits measuring the continuity of the propellant grain by means of electrical conductance measurements. These conductance measurements provide means of assessing the changes which take place in the solid propellant grain, such as, the physical and chemical changes (which affect mechanical properties) which the grain has undergone during storage or aging or when the grain is subjected to different load conditions, such as, acceleration, blast, shock, etc.

In addition to the benefit of the reliable means for assessing such changes, the propellant grains employing the tungstates show an unpredicted increase in the propellant burning rate. The propellant density also increased due to the high density of the tungsten bronzes, and this is another benefit.

7 Claims, 2 Drawing Figures

CONDUCTANCE METHOD FOR DETERMINING THE MECHANICAL PROPERTIES OF PROPELLANTS

DEDICATORY CLAUSE

The invention described herein may be manufactured, used, and licensed by or for the Government for governmental purposes without the payment to me of any royalties thereon.

BACKGROUND OF THE INVENTION

Solid propellant grains having many varieties of shapes, sizes, and formulations have been manufactured for civilian and military uses. Since the grain consists of many chemicals, it is essential that a stable condition exists, and the grain undergoes only minimum change or deterioration of its characteristics when the grain is to be stored for a period of time. The period of time for which propellant grains can be stored until they become unsafe to use will vary according to the environmental conditions to which the grains are exposed. It is essential that propellant grains be checked or monitored during storage to determine what changes may have occurred since the grains were manufactured.

Various methods of non-destructive testing have been used in monitoring propellant grains. Test firings of samplings of propellant grains that have been stored under various conditions have been accomplished to detect changes or to determine reliability. The test firing procedure is both expensive and time consuming. Non-destructive testing is, by far, the preferred if it provides the information necessary for the assessment of the propellant's condition. In the past, the means for determining the mechanical behavior of solid propellants under specified load conditions have been limited since a stress-strain law that describes such behavior did not exist. One means for assessing mechanical behavior has been the analog computer circuits; however, these computer circuits that have been synthesized to describe mechanical behavior or response are too complicated for efficient use.

Desirable would be a means for assessing mechanical behavior by non-destructive testing of solid propellant grains during storage.

The primary objective of this invention is to provide a simple procedure to establish whether a propellant grain has not undergone significant deterioration in its mechanical properties which would make it unsafe to fire.

Therefore an object of this invention is to provide a means for assessing mechanical properties of solid propellant grains.

Another object of this invention is to provide a solid propellant grain that has sufficient electrical conductivity to permit conductance measurements which serve as a means of assessing conditions of a solid propellant grain that can be correlated with mechanical properties and mechanical behavior under load conditions.

SUMMARY OF THE INVENTION

A technique for following the rate of change or deterioration that a solid propellant grain has undergone during storage has been innovated through changing the composition of the solid propellant grain from a non-conductive filled-elastomer into a highly-conductive filled-elastomer. Minimum change of the composition of the solid propellant grain is effected by the inclusion of an inorganic oxidizer, known as tungsten bronzes, which are the alkali-metal tungstates, generally sodium tungstates, whose empirical formula is $Na_{0.25}WO_3$. The cationic component is combined with the tungstate ions non-stoichiometrically, and the composition may range from $X_{0.25}WO_3$ to $X_{0.9}WO_3$, wherein X is an alkali metallic ion or ammonium ion.

A preferred tungsten bronze for such use, as indicated, is the analogous ammonium salt $NH_{40.25}WO_3$, particularly where reduction of radar attenuation is a factor to consider in missile systems which depend upon either command or semi-active guidance systems for communication, since sodium is an undesirable constituent because it is highly ionized in the missile's exhaust plume and interacts with the electromagnetic radiation.

Generally, tungsten bronze is referred to as an alkali-metal salt of polymerized tungstic acid. As used in this invention tungsten bronze also includes the analgous ammonium salt, $NH_{40.25}WO_3$. The oxygen content makes it an attractive oxidizer, and its other properties of conductance makes it particularly attractive for the designated use in accordance with this invention. As noted earlier herein, the analogous ammonium salt is grouped as equivalent substitute for the sodium salt. It is employed where the additional advantages are desired from the standpoint of radar attenuation. The ammonium tungstate has the following properties:

| | |
|---|---|
| Color: | white-yellow or colorless crystal |
| Density (g/cc) | 9.4 |
| Melting Point | d.200 |
| Solubility | 0.12 g. per 100 ml. cold water<br>2.2 g. per 100 ml. hot water |

Tungsten bronzes are used in the propellant composition in an amount from about 1 to 3 parts to replace a corresponding amount of the oxidizer, ammonium perchlorate. A polybutadiene-acrylic acid based propellant composition as modified contains about 66 parts of ammonium perchlorate, and 16 parts of aluminum metal fuel (Class III), about 15.875 parts of binder of polybutadiene-acrylic prepolymer with an effective amount of Bisphenol A curative (ERL-2774), and about 0.125 parts of ferric oxide catalyst. An effective amount of Bisphenol A curative may range from about 0.5 to 2.0 parts of the propellant composition. In addition to the benefit derived from the conductive properties of the modified propellant, the modified propellant has unexpected increased burning rates and increased density, both of these properties are very desirable for propellant grains.

DESCRIPTION OF THE PREFERRED EMBODIMENT

Figure 1:
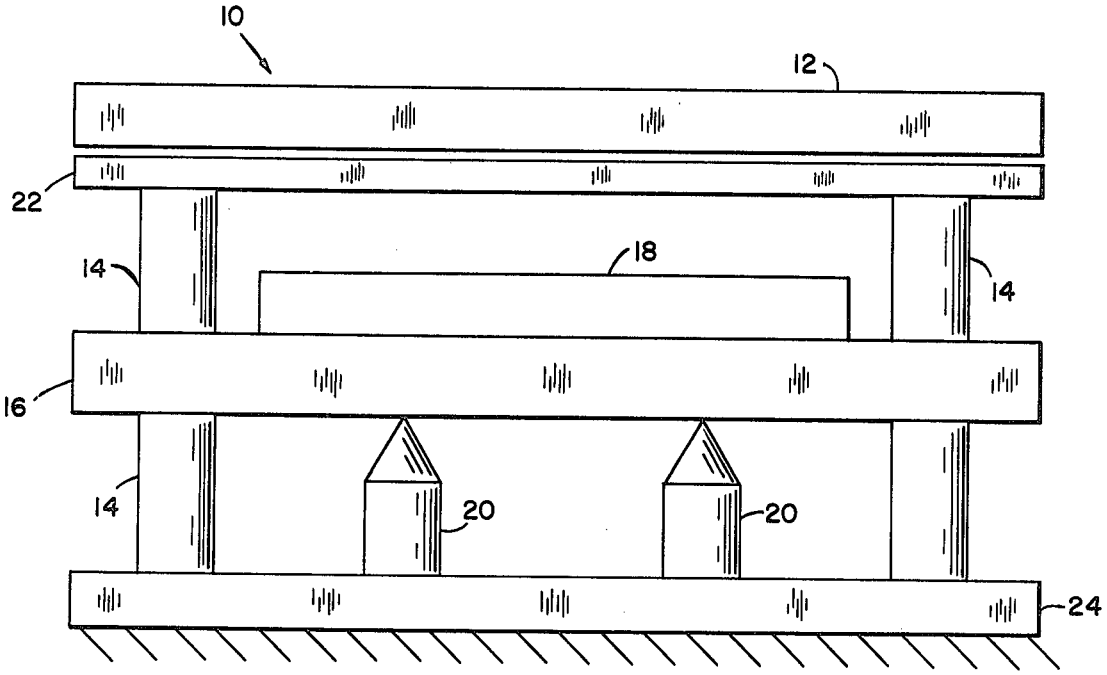
FIG. 1 of the drawing illustrates the test setup for determining volume resistivity of electrically conductive propellants.

Propellant formulations illustrated below as Examples I and II in Tables IA and IB, are control propellants, and these propellants are modified in accordance with this invention wherein 2 parts of tungsten bronze are used in the composition to replace two parts of ammonium perchlorate. The analogous ammonium salt is substituted in an equivalent amount where radar attenuation is of concern. Curing of the propellant composition to a propellant grain is accomplished in accordance with established procedures. The electrical conductivity of the grain is measured, and the mechanical properties of JANNAF test specimens are measured to establish an initial correlative relationship between the measured values. Re-measuring the electrical conductance and mechanical properties is accomplished after different periods of storage time have elapsed. This provides the means for interrelating the electrical conductance measurements with mechanical properties. If desired, the subsequent changes in mechanical properties can be predicted for similarly aged samples by merely making the conductance measurements and knowing what these values are from the previously established relationship.

TABLE IA.

COMPARISON OF PROPELLANTS WITH/WITHOUT TUNGSTEN BRONZE

| PROPELLANT INGREDIENTS/ CHARACTERISTICS | PROPELLANT FORMULATION (WEIGHT %) A | B |
|---|---|---|
| INGREDIENTS: | | |
| Ammonium Perchlorate | 68.0 | 66.0* |
| Tungsten Bronze ($Na_{0.25}WO_3$)** | — | 2.0 |
| Aluminum (Class III) | 16.0 | 16.0 |
| Polybutadiene-Acrylic Acid Prepolymer } | | |
| Curative (Bisphenol A)*** | 15.875 | 15.875 |
| Ferric Oxide | 0.125 | 0.125 |
| CHARACTERISTICS: | | |
| Burning Rate (ips at 1000 psi) | 0.36 | 0.8 |
| Density (lbm/in$^3$) (77° F.) | 0.062 | 0.074 |
| Theoretical Specific Impulse (Isps) (lbf-sec/lbm) | 260.7 | 262**** |
| Burning Rate Exponent | 0.31 | 0.33 |
| Temp. Coeff. of Press. (%/° F.) | 0.105 | Not Determined |

*may vary from about 65–67 wt-%
**available from Chemical Metallurgical Division, Sylvania Precision Products, Tomawanda, Pa 18848, Ammonium tungstate is available from K&K Laboratories, 121 Express St., Plainview, Long Island
***ERL-2774
****with 1% Sodium Bronze, ISPS = 263'

TABLE IB.

THE EFFECT OF SODIUM BRONZE ON THE CHARACTERISTICS OF TP-H-7043 PROPELLANT EXAMPLE II

| COMPOSITION | | TP-H-7034 PLUS SODIUM BRONZE (2 WT.%) |
|---|---|---|
| [Carboxyl-terminated polybutadiene prepolymer; Tris 1-(2-methylaziridinyl)phosphine oxide; Tris (2,3-epoxypropyl)-1,4-aminophenol]* | 10.50 | 10.50 |
| Ammonium perchlorate** | 71. | 69. |
| Aluminum | 16. | 16. |
| Catocene*** | 2.5 | 2.5 |
| Sodium Bronze | 0.0 | 2. |
| MECHANICAL PROPERTIES | | |
| End-of-Mix Viscosity (Kp/°F.) | 9.0/— | 7.0/145 |
| Burning Rate (Strand, uncured) (ips at 1000 psi) | 0.73 | 0.77 |
| Modulus (psi) | 1400 | 1200 |
| Maximum Stress (psi) | 385 | 350 |
| Strain at Maximum Stress (in./in.) | .45 | .47 |
| Strain at Cracking (in./in.) | .50 | .55 |
| EXPLOSIVE PROPERTIES | | |
| Impact Sensitivity (Kg-cm) | 74 | 80 |
| Electrostatic Discharge | 2(+) | 3(+) |
| No Fire at 245° F. (Days) | 10 | 10 |
| Screw Friction (300 in.-lbs.) | | |
| Silicon Carbide | Neg. | Neg. |
| Pyrex | Neg. | Neg. |
| Calcium Fluoride | Neg. | Neg. |

*Curing Agent/CTPB ratio was 0.87/1
**73 parts unground + 27 parts 20-micron
***Liquid ferrocene catalyst Table II below illustrates the large change in the resistivity value when sodium bronze is employed in the propellant composition. The measured specific resistance and the measured mechanical properties are correlated so that an acceptable value range for each is established. The values, shown in Table II, indicate sodium bronze actually enhances the mechanical properties while serving as a means for detecting changes which are detrimental to the mechanical properties. The resistance readings can also be used as a quality control media for determining if proper mixing has been accomplished.

TABLE II.

CHANGES WHICH OCCURRED IN THE MECHANICAL PROPERTIES OF TP-H-7034 AND TP-H-7034 CONTAINING 2 WEIGHT-PERCENT OF SODIUM BRONZE ON ACCELERATED AGING

| | TP-H-7034 | | TP-H-7034 EXP. | |
|---|---|---|---|---|
| | 0 mos. | 3 mos. | 0 mos. | 3 mos. |
| Modulus (psi) | 1400 | 2100 | 1200 | 1450 |
| Maximum Stress (psi) | 385 | 200 | 350 | 300 |
| Strain at Maximum Stress (in./in.) | 0.45 | 0.35 | 0.47 | 0.45 |
| Strain at Cracking (in./in.) | 0.50 | 0.37 | 0.55 | 0.52 |
| Logarithm of Specific Resistance | 7–8 | 7–8 | 2–3 | 2–3 |

FIG. 1 is a schematic of a test setup 10 for determining volume resistivity of electrically conductive propellants containing tungsten bronze. The setup includes weight 12 for applying contact force between current electrodes 14 and propellant specimen 16 and weight 18 for applying contact force between 16 and potential electrodes 20. Insulation 22 is positioned between weight 12 and the current electrodes 14. Block 24 is an insulated base plate that contains a means for positioning the electrodes (a dc power source and instrumentation for measuring the potential difference and current flow are not shown).

The experimental procedure which was used in assessing the efficacy of tungsten bronze in changing the conductimetric characteristics of solid propellants was the American Society for Testing Materials' Standard Method of Test, entitled: "VOLUME RESISTIVITY OF ELECTRICALLY CONDUCTIVE AND ANTI-STATIC ELASTOMERS."

Resistivity is the resistance per unit thickness offered to the flow of current through an insulation or conductive material when subjected to a voltage gradient.

The test consisted of impressing a dc voltage across the specimen, and the current through the specimen was adjusted so that the power dissipation between the potential electrodes was approximately 0.1 W. As soon as the current had stabilized, in a maximum time of 5 s., the potential difference across the potential electrodes and the current through the current electrodes were measured.

Figure 2:
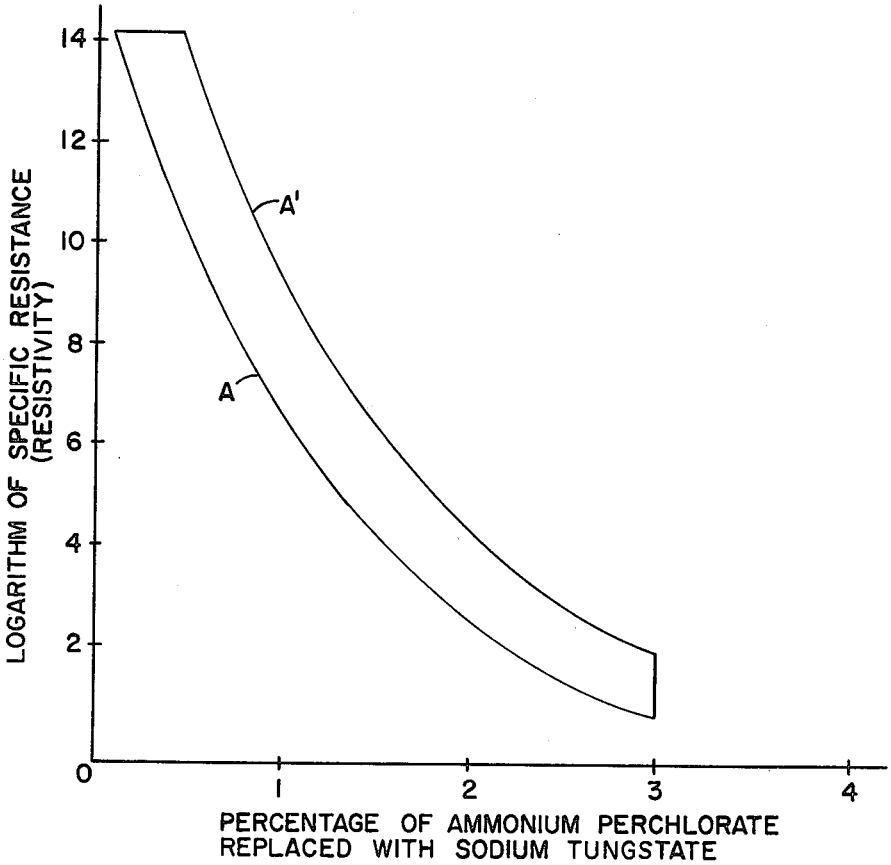
FIG. 2 of the drawing is a graph illustrating changes in resistivity of propellant when percentages of ammonium perchlorate is replaced with an optimum amount of sodium tungstate.

FIG. 2 of the drawing illustrates the effect of increasing sodium tungstate content on specific resistance of solid propellants. When from about 1 to about 3 weight percentage of the ammonium perchlorate is replaced with an equal amount of tungsten bronze the change in resistivity of the propellant is vividly depicted by resistivity range curve A and A'.

No degradation of performance occurs as a result of such a substitution of tungsten bronze for ammonium perchlorate because of the improvement in impulse-specific weight or impulse-density. The specific weight of tungsten bronze exceeds that of the specific weight of the fuels which have been especially explored to achieve high impulse-specific weight propellant formulations. Table III contains such a comparison.

TABLE III.

COMPARISON OF THE SPECIFIC WEIGHT OF PROPELLANT INGREDIENTS

| INGREDIENT | SPECIFIC WEIGHT (g/ml) |
|---|---|
| Ammonium Perchlorate | 1.95 |
| Aluminum | 2.70 |
| Zirconium | 6.4 |
| Zirconium Hydride | 5.6 |
| Chromium | 7.2 |
| Titanium | 4.5 |
| Tungsten | 19.3 |
| Tungsten Bronze | 9.2 |

The inclusion of the tungsten bronzes, as partial replacements for the ammonium perchlorate, in a solid propellant composition will permit measuring the continuity of the propellant grain by means of electrical conductance measurements. These conductance measurements provide means of assessing certain features of the solid propellant, such as, non-homogeneity of the propellant, dewetting of the oxidizer from the binder, strain-induced anisotropy in the grain, grain cracking, etc.

The use of tungsten bronzes also provide a mechanism for determining mechanical stiffness or the modulus of a propellant grain. While the phenomena for controlling conductivity and mechanical stiffness are different, (conductivity in such a propellant formulation would be electron tunnelling while stiffness is developed by chain entanglement of the propellant matrix primary bond forces, and van der Waals' attractive forces between the matrix and the solid ingredients in the propellant) imposed strains should effect simultaneous changes in these parameters. This would provide a means for describing the mechanical behavior of solid propellants under different mechanical load conditions.

In further evaluating the means for assessing changes in propellant grains, propellant A and propellant B were measured after three months of aging. There was an evident change in conductivity which paralleled the changes in the measured mechanical properties during a comparable time frame. It was concluded that there was an overall change which was due to the accumulated effects of non-homogeneity in the propellant, dewetting of the oxidizer from the binder, strain-induced anisotropy within the propellant grain, etc.

This conductance technique demonstrated that it was a useful tool in determining changes which occurred in a propellant grain during aging and some insight into how satisfactorily the constituents of the propellant were dispersed during the manufacture of the propellant.

I claim:

1. A conductance method for assessing the changes that can occur in a solid propellant grain during storage, said changes being related to changes in electrical conductances which provide a means for determining when said propellant grain has undergone an adequate level of deterioration that would render said propellant grain unsafe for firing, said conductance method for assessing the changes including indirectly correlating said electrical conductances with measured mechanical properties of a propellant grain that has been changed from a non-conductive filled elastomer into a highly-conductive filled elastomer, said method comprising:

(i) introducing an effective amount, from about 1 to about 3 parts in each hundred parts of propellant ingredients, of a tungstate selected from the tungstates consisting of the tungstates having an empirical formula $X_{0.25}WO_3$ to $X_{0.9}WO_3$, where X is an alkali metal ion or $NH_4$ ion, into an uncured non-conductive propellant composition to change the uncured non-conductive propellant composition into a highly-conductive propellant composition when cured to form a propellant grain, said non-conductive propellant composition comprised of ammonium perchlorate oxidizer from about 65 to about 69 parts, aluminum metal fuel, binder selected from the group consisting of polybutadiene-acrylic acid prepolymer with an effective amount of Bisphenol A curative and carboxy-terminated polybutadiene with curing agent comprised of tris 1-(2-methylaziridinyl) phosphine oxide and tris (2,3-epoxypropyl)-1,4 aminophenol, and ferric oxide catalyst;

(ii) curing said propellant composition to form a propellant grain that is highly conductive;

(iii) measuring the electrical conductance and mechanical properties of said propellant grain which include modulus, maximum stress, strain at maximum stress, and strain at cracking to establish a first correlative relationship between the measured value of conductance and of said mechanical properties;

(iv) re-measuring the electrical conductance and said mechanical properties after an aging period of about three months and after subsequent periods of storage times have elapsed for said propellant grain to establish a second and subsequent correlative relationship between the re-measured values of conductance and of said mechanical properties; and thereafter, (v) correlating changes in said re-measured values of electrical conductance which parallel the changes which are re-measured in said mechanical properties during a comparable time frame to indicate changes in said mechanical properties of said propellant grain due to accumulated effects of non-homogeneity in said grain, dewetting of the oxidizer from the binder of said grain, strain-induced anisotropy within said propellant grain, and the like.

2. The method of claim 1 wherein said effective amount of said tungstate is about 2 parts with said ammonium perchlorate of about 66 parts.

3. The method of claim 2 wherein said tungstate is $Na_{0.25}WO_3$.

4. The method of claim 2 wherein said tungstate is $NH_{40.25}WO_3$.

5. The method of claim 1 wherein said effective amount of said tungstate is about 2 parts with said ammonium perchlorate of about 69 parts.

6. The method of claim 5 wherein said tungstate is $Na_{0.25}WO_3$.

7. The method of claim 5 wherein said tungstate is $NH_{40.25}WO_3$.

* * * * *